US011986045B2

(12) United States Patent
Head et al.

(10) Patent No.: US 11,986,045 B2
(45) Date of Patent: May 21, 2024

(54) SOLE INCLUDING CLOSED LOOP SUPPORT MEMBER

(71) Applicant: Deckers Outdoor Corporation, Goleta, CA (US)

(72) Inventors: Matthew James Head, Santa Barbara (GB); Thibaut Poupard, Annecy-le-Vieux (FR)

(73) Assignee: Deckers Outdoor Corporation, Goleta, CA (US)

( * ) Notice: Subject to any disclaimer, the term of this patent is extended or adjusted under 35 U.S.C. 154(b) by 108 days.

(21) Appl. No.: 17/187,720

(22) Filed: Feb. 26, 2021

(65) Prior Publication Data

US 2022/0273070 A1 Sep. 1, 2022

(51) Int. Cl.
*A43B 13/10* (2006.01)
*A43B 13/02* (2022.01)

(52) U.S. Cl.
CPC ..... *A43B 13/10* (2013.01); *A43B 13/026* (2013.01)

(58) Field of Classification Search
None
See application file for complete search history.

(56) References Cited

U.S. PATENT DOCUMENTS 6,477,791 B2 11/2002 Luthi et al.
6,502,330 B1 * 1/2003 David ..... A43B 3/0052 36/43
7,886,460 B2 * 2/2011 Teteriatnikov ..... A43B 13/145 36/31
8,984,775 B2 * 3/2015 Dombrow ..... A43B 23/0295 36/76 R
9,119,438 B2 * 9/2015 Auger ..... A43B 7/142
9,578,920 B2 * 2/2017 Grott ..... A43B 7/1445
9,591,891 B1 * 3/2017 Baucom ..... A43B 13/122
9,629,413 B2 4/2017 Stien
9,968,160 B2 5/2018 Peyton
10,182,611 B2 1/2019 Auger et al.
10,231,517 B2 * 3/2019 Baucom ..... A43B 13/122
10,448,701 B2 10/2019 Farris et al.
10,448,704 B2 10/2019 Dupre et al.
10,758,001 B2 * 9/2020 Case ..... A43B 13/12
10,945,489 B2 3/2021 Conrad et al.
11,000,093 B2 5/2021 Connell et al.
2003/0221337 A1 * 12/2003 Farys ..... A43B 5/003 36/113
2013/0139412 A1 * 6/2013 Auger ..... A43B 13/184 36/25 R
2016/0058122 A1 * 3/2016 Foxen ..... A43B 13/181 36/28
2017/0055634 A1 * 3/2017 Baucom ..... A43B 13/04
2017/0119093 A1 * 5/2017 Grott ..... A43B 13/186
2018/0168281 A1 * 6/2018 Case ..... A43B 13/026

* cited by examiner

*Primary Examiner* — Jila M Mohandesi
(74) *Attorney, Agent, or Firm* — Greer, Burns & Crain, Ltd.

(57) ABSTRACT

An article of footwear is provided and includes a sole having a forefoot portion, a midfoot portion and a heel portion and a support member including a first part and a second part. The first part of the support member extends at least partially into the forefoot portion, and the second part of the support member extends from the first part and at least partially into a portion of the sole that is in or between the midfoot portion and the heel portion, where the first part forms a loop defining an opening.

20 Claims, 8 Drawing Sheets

SOLE INCLUDING CLOSED LOOP SUPPORT MEMBER

BACKGROUND

The present application relates generally to footwear, and more particularly, to a sole including a support member for footwear that support a user's feet while efficiently transferring energy from the user's legs and feet to optimize running efficiency during walking, jogging and running while reducing fatigue.

Running involves the transfer of energy between a person's legs and feet and an underlying surface, such as the ground, contributing to propel a person forward along a trail, a sidewalk, a street or other path. The power a person is able to produce and the speed at which a person is able to move in a forward direction depends on a number of factors. For example, the ability to properly apply forces on a surface affects the energy produced and the rate of speed that the person is able to move. In particular, the propulsion generated by a person's legs and feet is important while jogging or running. If a person's feet are not sufficiently supported by their shoes and their feet to do not have a stable push off point, less energy could be transferred from the person's feet to the ground to propel the person forward.

Running outdoors, and more specifically, running on trails involves inclines, declines and different terrains and weather conditions. Due to these factors, it is important for a runner to maintain stability and control while running. It is also important for a runner's feet to be sufficiently supported and cushioned as they encounter different terrains, such as pavement in urban environments and gravel and rocks on trails and more rural environments. Runners may also encounter steep inclines or declines on trails with hills or trails in mountainous areas.

It is therefore desirable to provide footwear that supports a person's feet during walking, jogging and running that allows for efficient climbing, edging and gripping of underlying surfaces in different terrains to optimize force application and energy transfers while maintaining support and stability to enhance a person's walking and running efficiency.

SUMMARY

The present article of footwear has a sole and a support member that provide enhanced balance on different types of terrain, and stability and enhanced propulsion to a user's foot during walking, jogging and running on the different terrain.

In an embodiment, an article of footwear is provided and includes a sole having a forefoot portion, a midfoot portion and a heel portion and a support member including a first part and a second part. The first part of the support member extends at least partially into the forefoot portion, and the second part of the support member extends from the first part and at least partially into a portion of the sole that is in or between the midfoot portion and the heel portion, where the first part forms a loop defining an opening.

In another embodiment, a footwear component is provided and includes a support member configured for placement on a sole of a shoe, the support member includes a first part and a second part. The first part extends at least partially into a forefoot portion of the sole, and the second part extends from the first part and at least partially into a heel portion of the sole, where the second part forms a closed loop having a central opening.

DETAILED DESCRIPTION

The present invention includes a support member positioned on or within a sole of an article of footwear where the support member stabilizes and supports a user's feet during walking, jogging and running while enhancing propulsion. More specifically, the present support member includes a first part that extends to a heel area of the sole and a second part that extends to a forefoot area of the sole where the second part extends about a peripheral edge of the forefoot area and defines a central through-hole that provides support to the peripheral region of the forefoot area of a user's foot to enhance stability and propulsion during movement.

Figure 1:
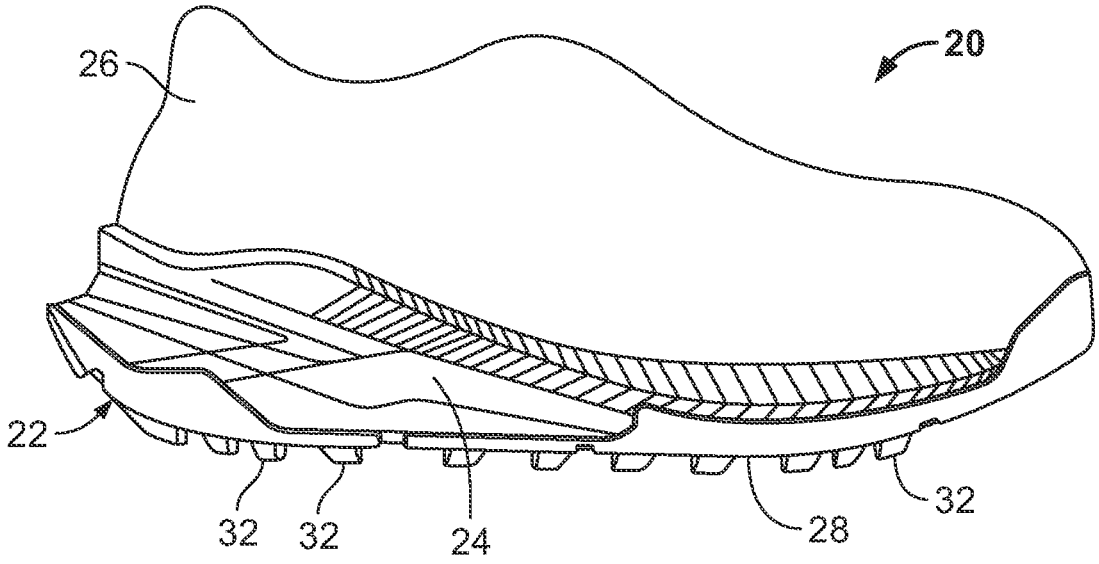
FIG. 1 is a perspective view of an embodiment of an article of footwear including the present support member.
Figure 2:
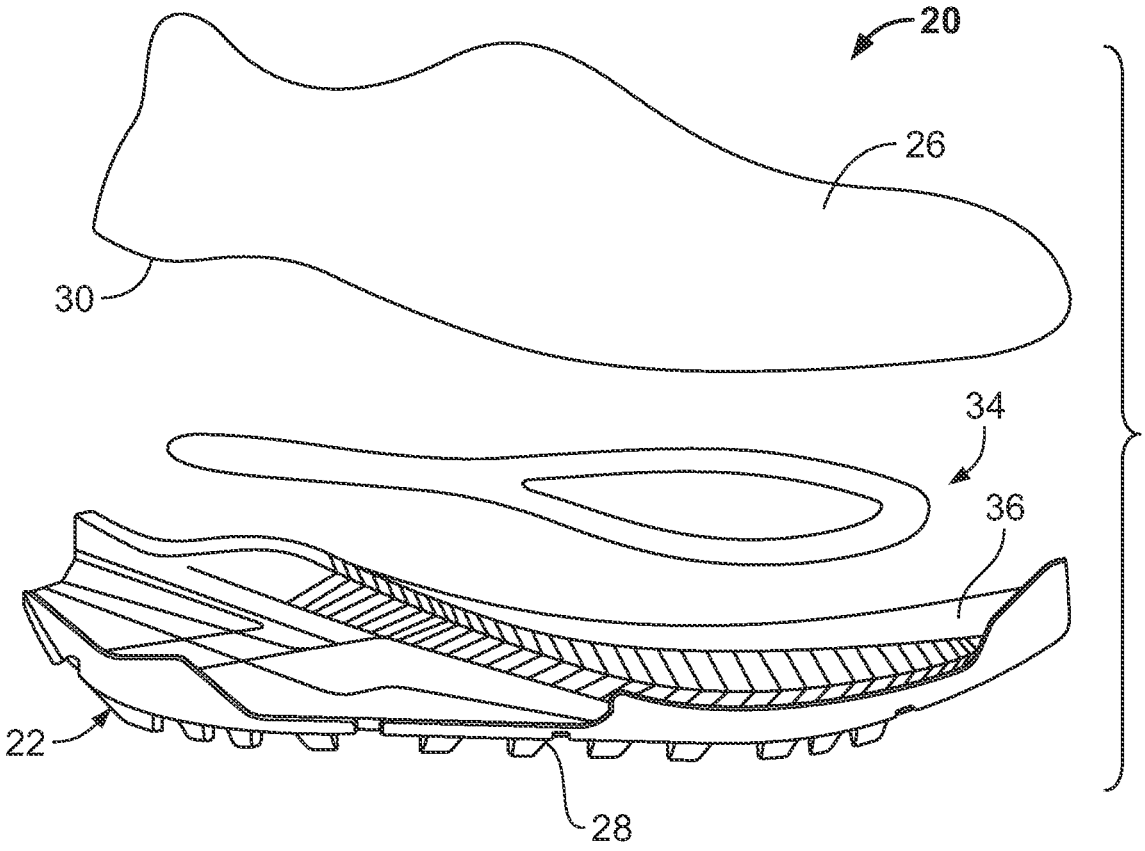
FIG. 2 is an exploded perspective view of the article of footwear of FIG. 1.

Referring now to FIGS. 1 and 2, an article of footwear 20 includes an embodiment of the present sole, generally indicated as 22, where the sole 22 includes a midsole 24 attached to an upper 26, and an outsole 28. The midsole 24 may be an integral, molded component made of a material having a designated hardness value or made with different materials having the same or different hardness values. For example, one or more portions of the midsole 24 may be made with a material having a hardness or hardness value that is greater than a hardness or hardness value in other areas of the midsole to increase the stability and support in designated areas of the midsole. As shown in FIG. 1, the outsole 28 is attached to a bottom surface 30 of the midsole 24 by an adhesive or by molding, and is made of rubber. The outsole 28 typically includes a plurality of tread members 32 that are configured to grip an underlying surface, such as the ground, during movement. It should be appreciated that the midsole 24 and outsole 28 may be made of any suitable materials or combinations of materials.

Figure 3:
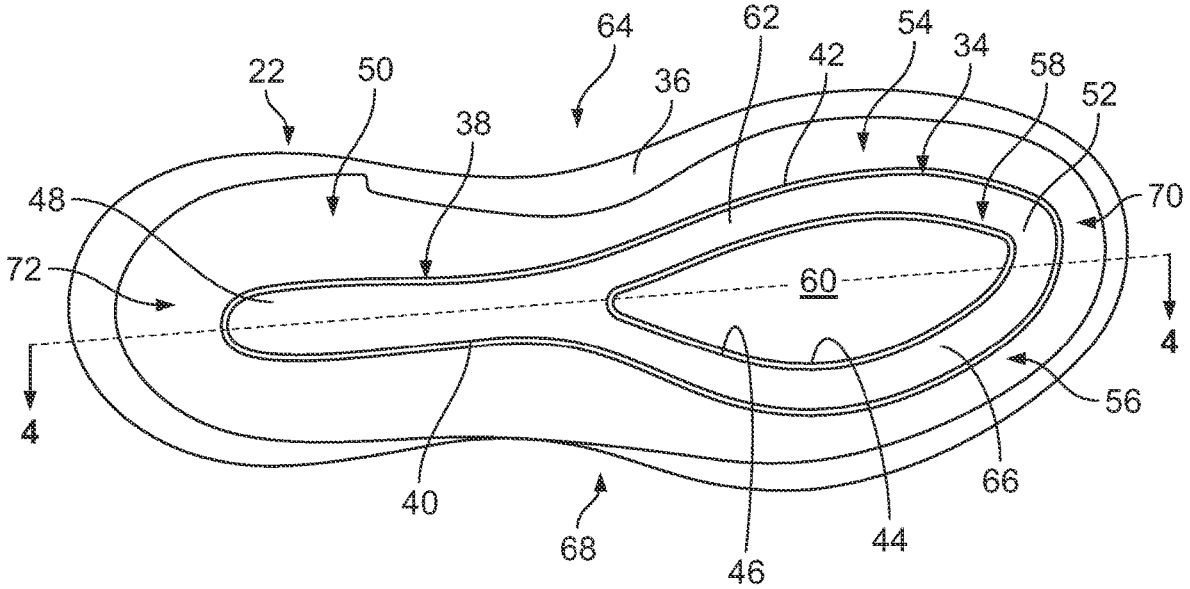
FIG. 3 is a top view of the sole of FIG. 1 with the support member on the sole.
Figure 4:
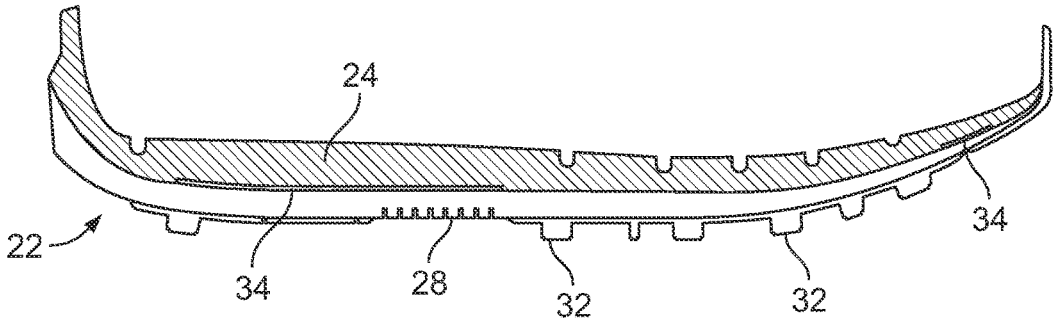
FIG. 4 is a cross-section view of the sole and the support member shown in FIG. 3 substantially along line 4-4 in the direction generally indicated.

Referring now to FIGS. 3-7, an embodiment of support member is shown and generally indicated as 34, where the support member 34 is placed on an upper surface 36 of the sole 22 such that the support member is between the sole 22 and the upper 26 of the article of footwear 20. In another embodiment, the upper surface 36 of the sole 22 includes a recessed area 38 having shape and depth that corresponds to the shape and thickness of the support member 34. As shown in FIG. 3, the recessed area 38 has a uniform depth and a shape that corresponds to the shape or contour of the outer peripheral surface 40 of the support member 34. In another embodiment, the recessed area 38 has a shape that corresponds to the specific shape of the support member 34 such that the recessed area has an outer edge 42 with a shape that corresponds to the shape or contour of the outer peripheral surface 40 of the support member 34 and an inner edge 44 that corresponds to the inner surface 46 of support member. In this way, the recessed area 38 limits the movement of the support member 34 relative to the sole 22. In a further embodiment, the support member 34 is positioned within the sole 22 by securing the support member between the midsole 24 and the outsole 28 using adhesive or another suitable attachment method, or by embedding the support member 34 in the sole 22 by placing the support member 34 in a mold and forming the sole 22 with a material that surrounds the support member.

Figure 5:
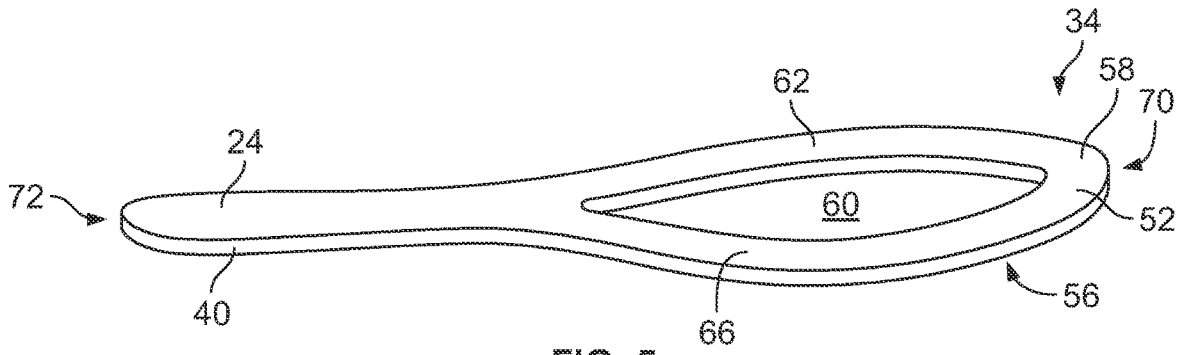
FIG. 5 is a perspective view of an embodiment of the present support member.
Figure 6:
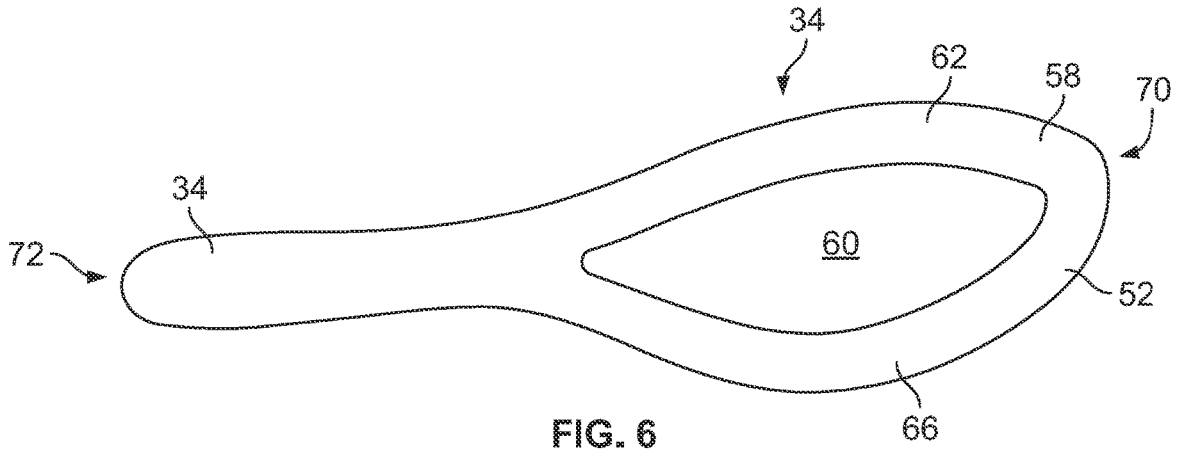
FIG. 6 is a top view of the support member of FIG. 5.
Figure 7:
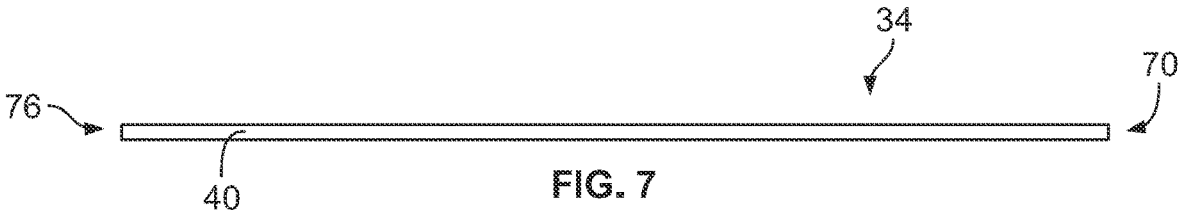
FIG. 7 is a right side view of the support member of FIG. 5, where the left side view is a mirror image thereof.

In an embodiment, the support member shown in FIGS. 5 to 7, has a first part 48 forming a loop and a second part 52 extending from the first part. Specifically, the second part 52 has an elongated, narrow shape and extends at least partially into a heel area 50 of the sole 22 and the first part 52 extends from the second part 52 to a point that is at least partially into a forefoot area 54 of the sole 22 and forms the loop 56 having a peripheral wall 58 defining a central through-hole 60. As shown in FIG. 3, the peripheral wall 58 of the first part 48 of the support member 34 is formed by a medial support arm 62 that extends along the medial side 64 of the sole 22 and a lateral support arm 66 that extends along the lateral side 68 of the sole 22. The medial support arm 62 and the lateral support arm 66 both extend from the second part 52 of the support member 34 and are integrally joined or formed together at a common end, and define the central through-hole 60. In this way, the medial support arm 62 and lateral support arm 66 provide stability and support to the medial side and the lateral side of the forefoot area and/or to the toe area of a user's foot during movement while providing cushioning in the central area of the forefoot via the portion of the sole located at the through-hole 60 of the support member 34.

Figure 8:
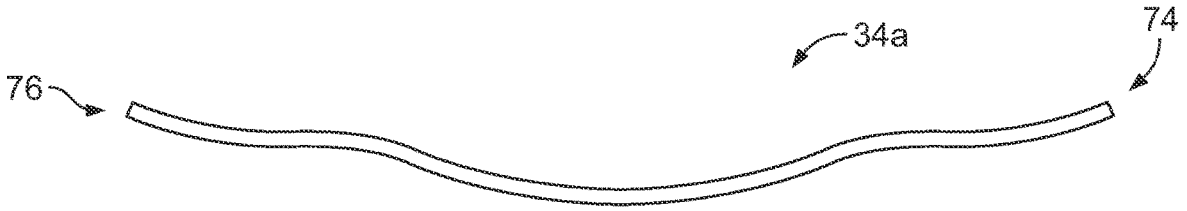
FIG. 8 is a right side view of another embodiment of the present support member, where the left side view is a mirror image thereof.

As shown in FIG. 7, in an embodiment, the support member 34 has a designated length defined between a front end 70 and a rear end 72 of the support member, and is substantially flat along that length. This flat configuration provides uniform support and stability to a user's foot from the heel area to the forefoot area and/or toe area. In another embodiment show in FIG. 8, the front end 74 and the rear end 76 of the support member 34*a* are curved, and more specifically, curved upwardly or have a generally concave shape to provide resilient support to the heel area 50 and the forefoot area 54 of the sole 22 to enhance support in these areas as well as propulsion. It should be appreciated that the front end, the rear end or both the front end and the rear end of the support member may be curved to enhance the support and stability of the support member. For example, one end or both ends of the support member may have a concave shape and/or a convex shape.

In the illustrated embodiment, the support member 34 is a support plate that is preferably made of a carbon fiber material. The support member 34 may also be made with a metal, a composite material or any suitable material or combination of materials. In another embodiment, the different parts of the support member 34 have different thicknesses. For example, the first part 48 and the second part 52 of the support member 34 may have thicknesses that are different such that a thickness of the first part is less than or greater than a thickness of the second part. In this way, the thickness of the support member 34 may be adjusted to provide different levels of stability and support to different areas of a user's foot. For example, forming the support member 34 so that the first part 48 has a thickness that is less than a thickness of the second part 52, enables the first part 48 to flex (move upward or downward) relative to the second part 52 to enhance propulsion in the forefoot area 54 while maintaining a designated level of support in the heel area 50. In another example embodiment, the thickness of the medial support arm 62 is greater than or less than the thickness of the lateral support arm 66 of the support member 34. This configuration allows for adjustment of the support and stability of the support member 34 on the medial side 64 and lateral side 68 of the sole 22 to account for pronation or supination of a user's foot during movement.

Similar to varying the thicknesses of the support member 34, the materials that are used to make the support member may be different to provide different levels of support and stability to the different areas of a user's foot. For example, in an embodiment, the first part 48 of the support member is made of a first metal and the second part 52 of the support member is made of a second, different metal. In another embodiment, the first part 48 is made of a metal and the second part 52 is made of a composite material. Similarly, the medial support arm 62 and the lateral support arm 66 of the support member 34 may be made of the same material or different materials to adjust the flexibility and support provided by the medial support arm and the lateral support arm.

Figure 9:
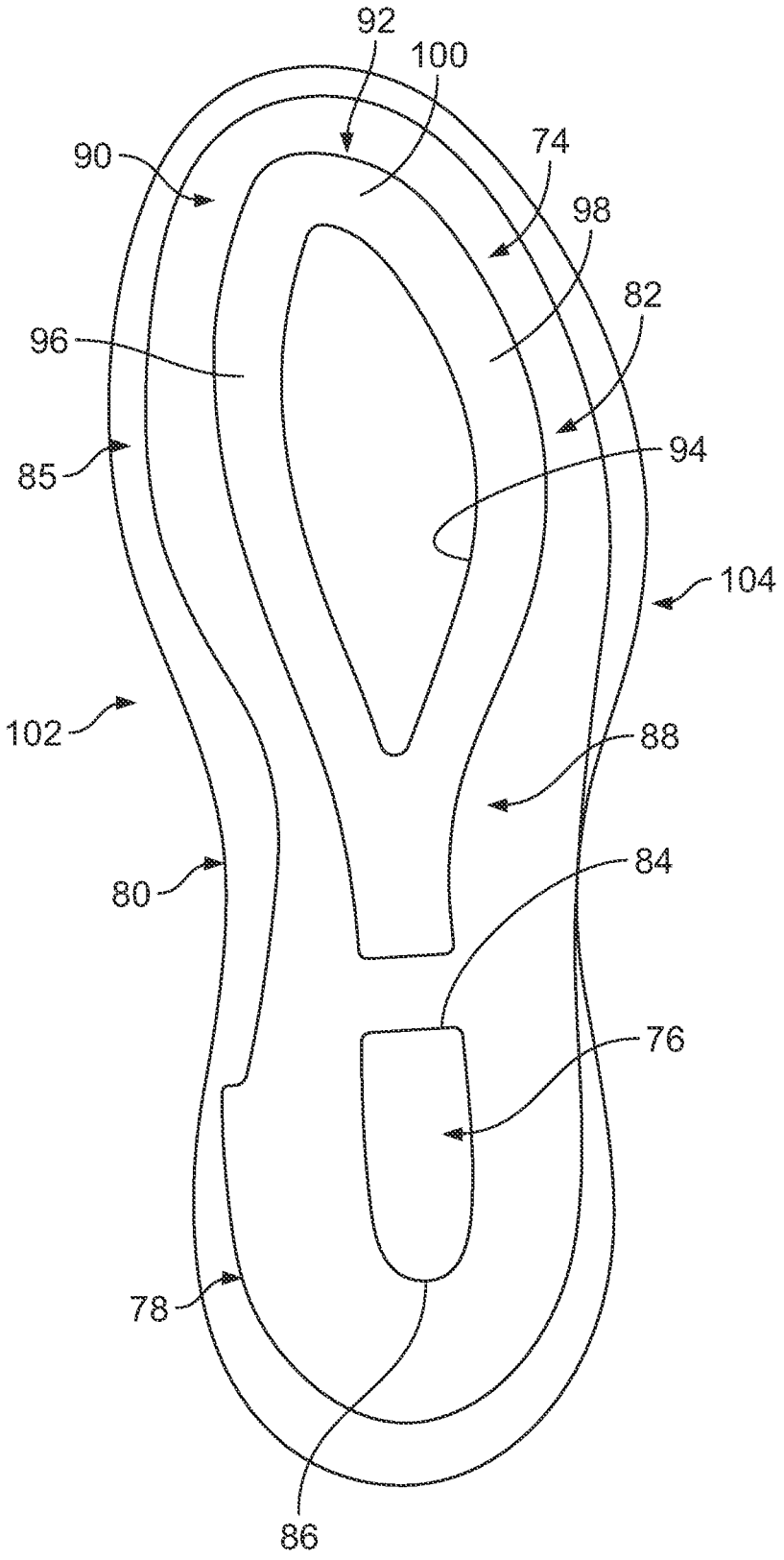
FIG. 9 is a top view of the present sole with another embodiment of the support member.
Figure 10:
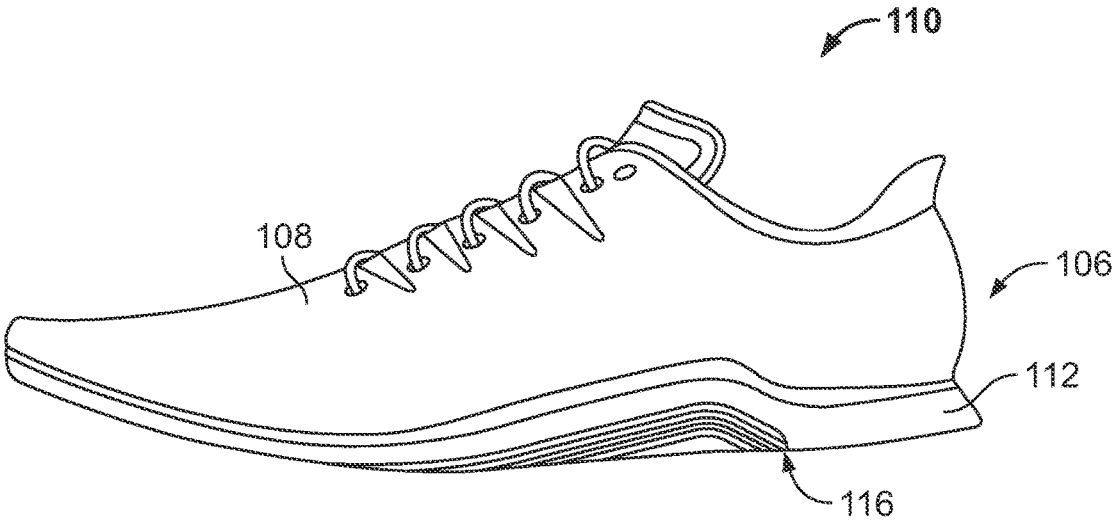
FIG. 10 is a perspective view of an article of footwear including a further embodiment of the support member and the outsole.

Referring to FIG. 9, another embodiment of the support member 74 is shown and includes a first part 76 forming a loop and a separate second part 82. Specifically, the second part 82 is positioned at least partially in a heel area 78 of the sole 80 and the separate, first part 76 is positioned at least partially in a forefoot area 85 of the sole 80. In this embodiment, the first part 76 and the second part 82 of the support member 74 are separated or spaced apart from each other on the sole. As shown in the illustrated embodiment, the second part 82 of the support member 74 has an elongated shape with a straight front end 84 and a rounded rear end 86. Further, the first part 76 has a rear end portion 88 and a front end portion 90 forming a loop 92 with a central opening or through-hole 94, that extends from the rear end portion 88. The loop 92 of the front end portion 90 is formed by a medial support arm 96 and a lateral support arm 98 that each extend from the rear end portion 88 and are joined or integrally formed together at common end 100. As shown, the medial support arm 96 follows the contour on the medial side 102 of the sole 80 and the lateral support member 98 follows the contour on the lateral side 104 of the sole 80. It should be appreciated that the first part 76 and the second part 82 may be any suitable size and shape. It should also be appreciated that the central through-hole 94 formed by the medial support member 96 and the lateral support member 98 may be any suitable size or shape. In the illustrated embodiment, the first part 76 and the second part 82 of the support member 74 are positioned on or within the sole 80. The first and second parts 76, 82 may also be positioned in corresponding recessed areas formed in the sole 80 to limit movement of the first and second parts relative to the sole.

Figure 11:
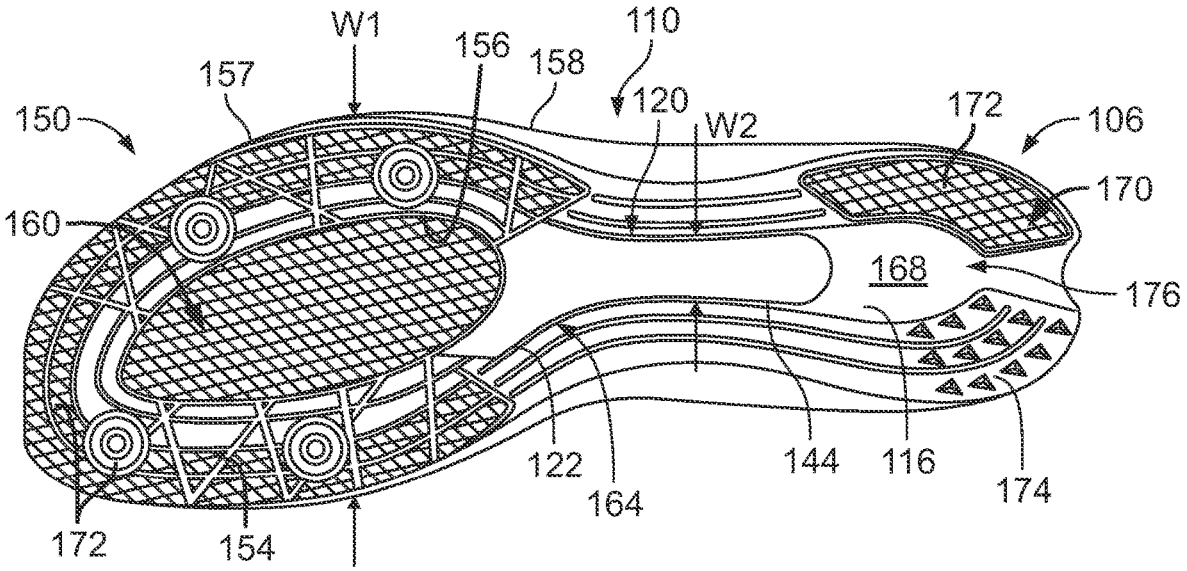
FIG. 11 is a bottom view of the article of footwear of FIG. 10 showing the bottom of the midsole and the outsole, and the support member.
Figure 12:
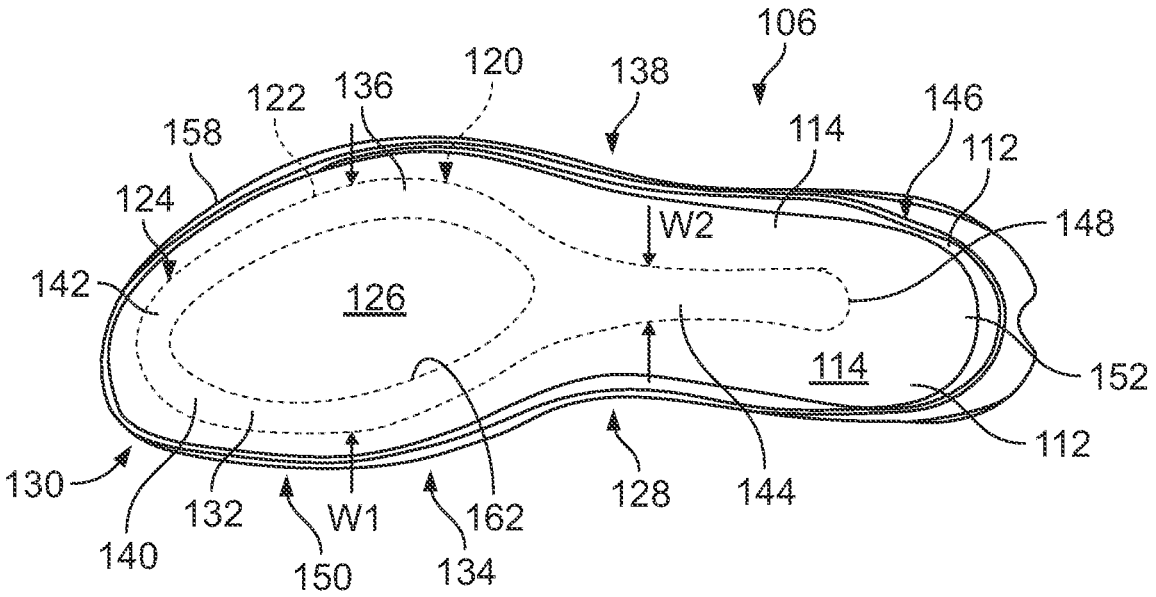
FIG. 12 is a top view of the sole of the article of footwear of FIG. 1.
Figure 13:
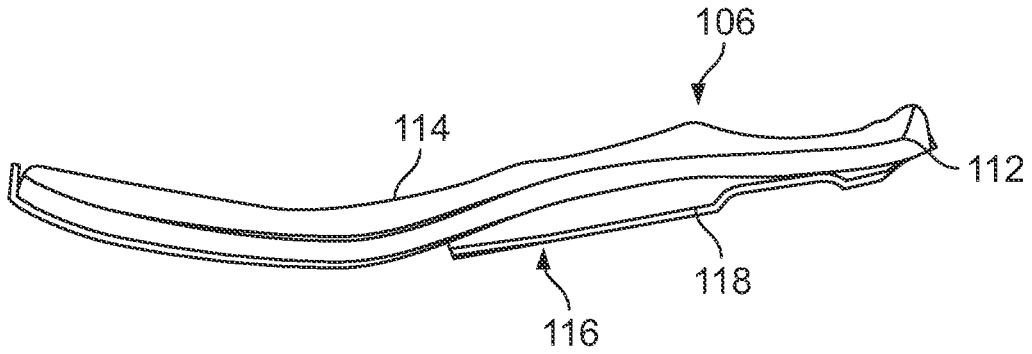
FIG. 13 is a left side view of the sole of FIG. 12 showing the midsole and the outsole.
Figure 14:
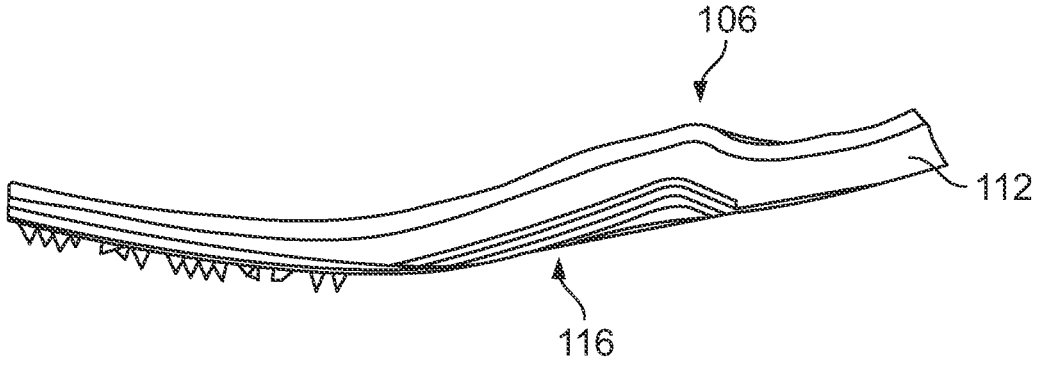
FIG. 14 is a right side view of the sole of FIG. 12 showing the midsole and the outsole.
Figure 15:
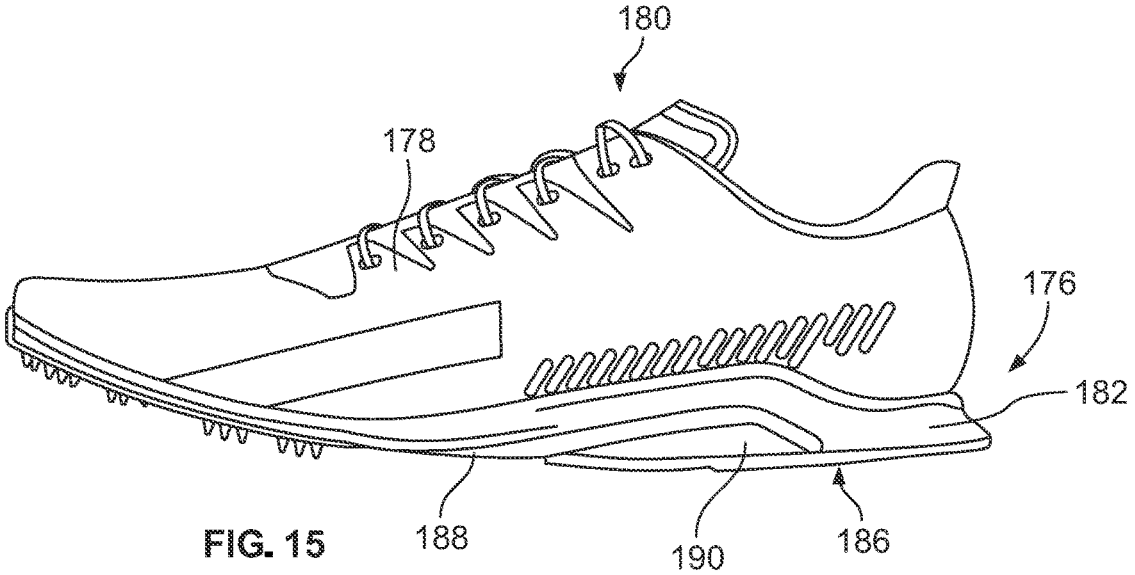
FIG. 15 is a perspective view of an article of footwear including another embodiment of the support member and the outsole.

Referring now to FIGS. 10-14, another embodiment of the present sole is shown and generally indicated as reference number 106 where the sole is attached to an upper 108 to form an article of footwear 110. The sole 106 includes a midsole 112 having an upper surface 114 attached to the upper 108, and an outsole 116 attached to a bottom surface 118 of the midsole 112. In this embodiment, a support member 120 is attached to or embedded in the bottom surface 118 of the midsole 112 and includes a first part 122 forming a closed loop 124 having a central through-hole 126, that extends from the midfoot area 128 to the toe area 130 of the sole. More specifically, the first part 122 includes a medial arm 132 that extends along the medial side 134 of the sole 106, and a lateral arm 136 that extends along the lateral side 138 of the sole 106. The medial arm 132 and the lateral arm 136 extend to the toe area 130 and connect to each other. In the illustrated embodiment, the lateral and medial arms 132 and 136 are integrally formed to form the closed loop 124. In another embodiment, the ends 140 and 142 of the medial and lateral arms 132 and 136 may be spaced from each other. As shown in FIG. 12, a second part 144 of the support member 120 extends from the first part 122 in the midfoot area 128 to the heel area 146 of the sole 106. It should be appreciated that the rear end 148 of the second part 142 of the support member 120 may be in the forefoot area 150, extend at least partially into the heel area 144 or extend to a back end 152 of the heel area 144. In this embodiment, the width W1 of the first part 122 (distance between the outer edges of the medial and lateral arms) is greater than the width W2 of the second part 142. It should be appreciated that the support member 120 may be made of a carbon-fiber based material as described above, or made with any suitable material or combination of materials.

As shown in FIG. 11, a first portion 154 of the outsole 116 extends about the periphery of the forefoot area 150 of the sole 106 and includes a central opening 156 that corresponds with the through-hole 126 formed in the first part 122 of the support member 120. The first portion 154 of the outsole 116 has an outer edge 157 that is flush with an outer edge 158 of the sole 106, and an inner edge 160 where the width W3 of the first portion is defined by the distance between the outer edge and the inner edge. In the illustrated embodiment, the inner edge 160 of the first portion 154 of the outsole extends past the inner edge 162 of the first part 122 of the support member 120 such that the first portion 154 covers a majority of the first part 122 of the support member as shown in FIG. 11. In the illustrated embodiment, a portion 164 of the first part 122 and a portion 166 of the second part 144 of the support member 120 are exposed on the bottom surface 168 of the sole 106. A second portion 170 of the outsole 116 is attached to the heel area on the bottom surface 118 of the midsole 112. In this embodiment, the outsole 116 and the midsole 112 combine to form the bottom surface of the article of footwear. As shown, the outsole 116 includes tread members 172 and the midsole 112 includes tread members 174 that each at least partially grip an underlying surface, such as the ground, during movement by a user. The first and second portions 154, 170 of the outsole 116 and the exposed portion 176 of the bottom surface of the midsole 112 may be made with the same material or different materials. For example, the outsole 116 and midsole 112 may both be made of EVA or rubber or the outsole may be made of rubber and the midsole may be made of EVA. It should be appreciated that the tread members 172, 174 may have the same size and shape or may have different sizes or shapes.

Figure 16:
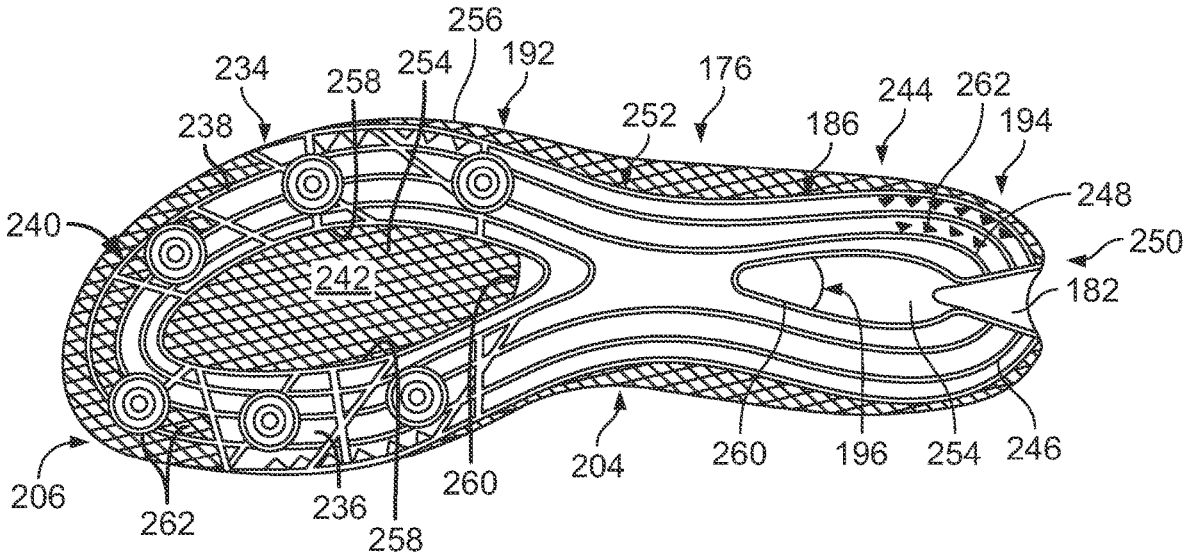
FIG. 16 is a bottom view of the article of footwear of FIG. 15 showing the bottom of the midsole and the outsole, and the support member.
Figure 17:
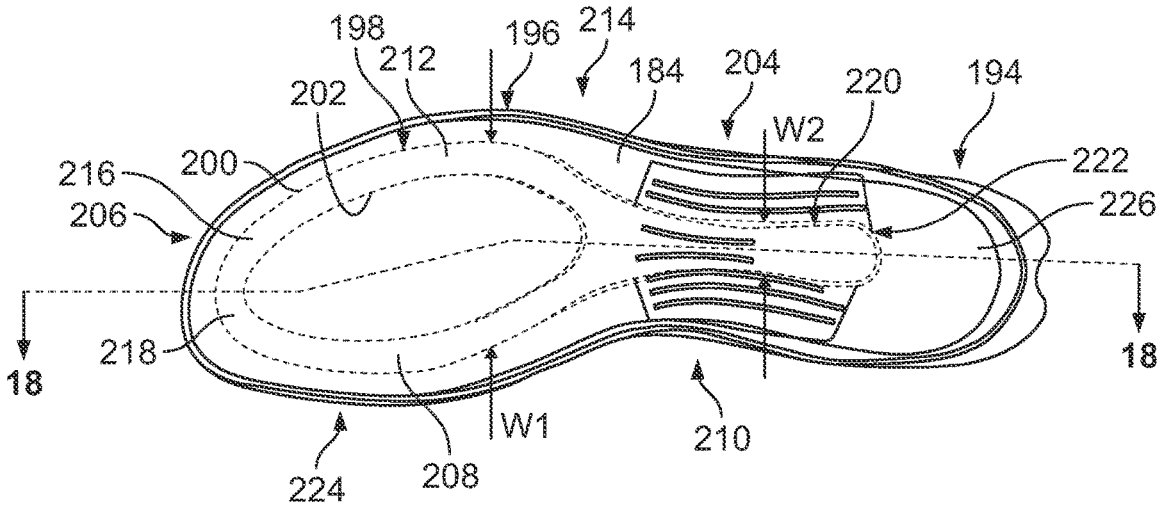
FIG. 17 is a top view of the sole of the article of footwear of FIG. 15.

Referring now to FIGS. 15-19, a further embodiment of the present sole is shown and generally indicated as reference number 176 where the sole is attached to an upper 178 to form an article of footwear 180. The sole 176 includes a midsole 182 having an upper surface 184 attached to the upper 178, and an outsole 186 attached to a bottom surface 188 of the midsole 182. In this embodiment, a space 190 is defined between the midsole 182 and the outsole 186 between the midfoot area 192 and the heel area 194 of the sole 176. The space 190 has a triangular shape but may have any suitable shape. As shown, a support member 196 is attached to or embedded in the bottom surface 188 of the midsole 182 and includes a first part 198 forming a closed loop 200 having a central through-hole 202, that extends from the midfoot area 204 to the toe area 206 of the sole 176. More specifically, the first part 198 includes a medial arm 208 that extends along the medial side 210 of the sole 176, and a lateral arm 212 that extends along the lateral side 214 of the sole 176. The medial arm 210 and the lateral arm 212 extend to the toe area 206 and connect to each other. In the illustrated embodiment, the medial and lateral arms 210, 212 are integrally formed to form the closed loop 200. In another embodiment, the ends 216, 218 of the medial and lateral arms 210, 212 may be spaced from each other. As shown in FIG. 17, a second part 220 of the support member 196 extends from the first part 198 in the midfoot area 204 to the heel area 194 of the sole. It should be appreciated that the rear end 222 of the second part 220 of the support member 196 may be in the forefoot area 224, extend at least partially into the heel area 194 or extend to a back end 226 of the heel area 194. In this embodiment, the width of the first part W1 (distance between the outer edges of the medial and lateral arms) is greater than the width W2 of the second part.

Figure 18:
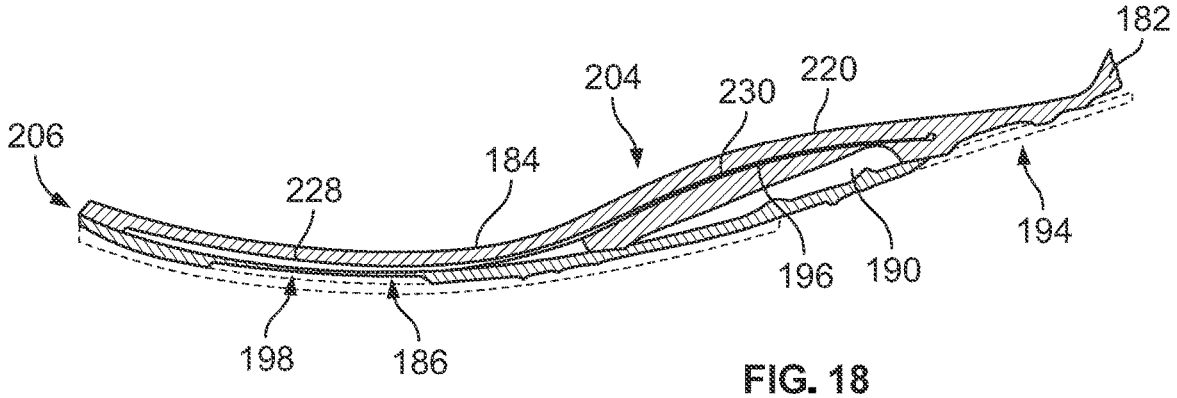
FIG. 18 is a cross-section view of the sole and the support member shown in FIG. 17 substantially along line 18-18 in the direction generally indicated.
Figure 19:
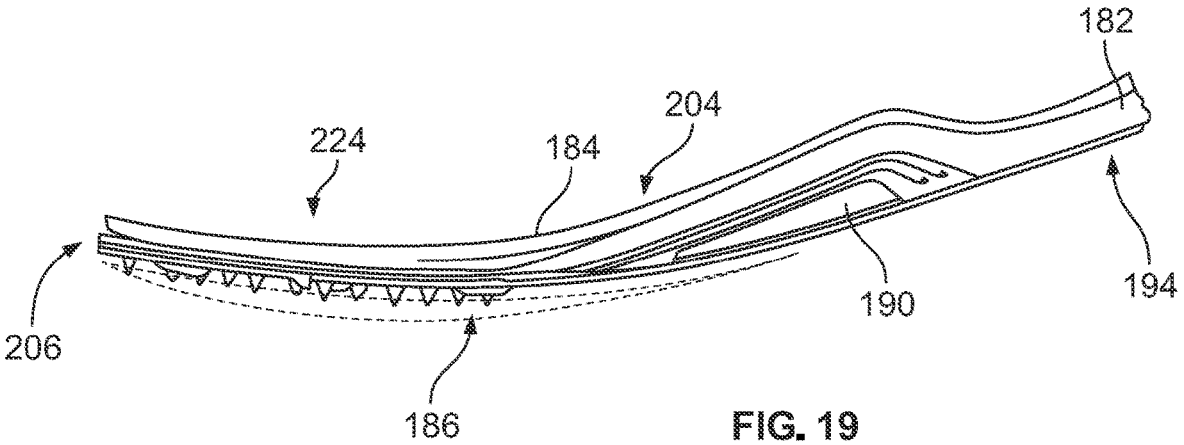
FIG. 19 is a left side view of the sole of FIG. 17 showing the midsole and the outsole.

Referring to FIG. 18, the support member 196 has a first curvature 228 forming a concave shape in the forefoot area 224 of the sole 176 and a second curvature 230 forming a convex shape in the midfoot area 204 and the heel area 194 of the sole. Specifically, the second curvature 230 of the support member 196 is positioned adjacent to or above the space 190 between the midsole 182 and the outsole 186 so that the support member 196 and the portion 232 of the midsole 182 surrounding the support member 196, may move downwardly into the space 190 upon pressure on the support member 196 by a user's foot, and move upwardly out of the space 190 when the pressure is released on the support member 196. In this way, the support member 196 provides resilient support to the forefoot and heel portions of a user's foot during movement. It should be appreciated that the second curvature 230 of the support member 196 may be positioned closer to a user's foot than to the space 190 as shown in FIG. 18 or alternatively, the support member 196 may be positioned closer to the space 190 than to the user's foot. The positioning of the support member 196 in the midsole 182 depends on the desired level of support in the different areas of a user's foot.

In this embodiment, the outsole 186 has a front part 234 with medial and lateral arms 236, 238 that form an integral closed loop 240 with a central opening 242. A rear part 244 of the outsole 186 has a rear medial arm 246 and a rear lateral arm 248 that are spaced apart and curve toward each other at the rear end 250 of the sole 176. A middle part 252 of the outsole 186 extends between the front part 234 and the rear part 244. As shown in FIG. 16, the outsole 186 and a portion 254 of the midsole 182 combine to form the bottom surface of the article of footwear. The medial and lateral arms 236, 238 of the front part 234 of the outsole 186 each have a width (distance between the outer and inner edges of the medial and lateral arms) that extends from the peripheral edge 256 of the sole to the inner edges 258 of the medial and lateral arms 236, 238 such that the medial and lateral arms cover the first part 198 (closed loop) of the support member 196. Similarly, the middle part 252 and the rear part 244 of the outsole 186 have a size and shape that substantially covers the second part 220 of the support member 196. As shown in FIG. 16, portions 260 of the support member 196 are exposed on the bottom surface of the article of footwear. In another embodiment, the outsole 186 completely covers the support member 196 such that no portion of the support member is exposed and visible on the bottom surface of the article of footwear. In this embodiment, the rear medial arm 246 and the rear lateral arm 248 of the rear part 244 of the outsole 186 are spaced from each other so that the rear medial arm and the rear lateral arm may move relative to each other to provide the same or different levels of support to the medial and lateral sides of the heel during movement. The different parts of the outsole 186 are preferably made of the same material, such as rubber, but may be made with different materials to provide different levels of support and grip. As shown, the outsole 186 has tread members 262 that at least partially grip an underlying surface during movement. The tread members 262 may be any suitable size and shape.

While particular embodiments of the present sole are shown and described, it will be appreciated by those skilled in the art that changes and modifications may be made thereto without departing from the invention in its broader aspects and as set forth in the following claims.

What is claimed is:

1. An article of footwear comprising:

a sole having a forefoot portion, a midfoot portion and a heel portion; and a support member including a first part and a second part, said first part extending at least partially into the forefoot portion, and said second part extending from said first part and at least partially into a portion of the sole that is in or between the midfoot portion and the heel portion, said first part including a lateral support member and a medial support member that are connected together to form a continuous loop defining an opening, an outer edge of said lateral support member and said medial support member combining to form an outermost edge having a continuous convex curvature from a lateral side to a medial side of said sole, said support member having a front end portion having a concave curve in a vertical direction and a rear end portion having a concave curve in a vertical direction.

2. The article of footwear of claim 1, wherein said medial support member extends along a medial side of said sole, and said lateral support member extends along a lateral side of said sole.

3. The article of footwear of claim 2, wherein said medial support member and said lateral support member are curved.

4. The article of footwear of claim 1, wherein said first part of said support member extends from a midfoot portion of said sole to said forefoot portion.

5. The article of footwear of claim 1, wherein said second part of said support member extends from a midfoot portion of said sole to said heel portion.

6. The article of footwear of claim 1, wherein said first part has a width that is greater than a width of said second part of said support member.

7. The article of footwear of claim 1, wherein said sole includes a recessed area and said support member is seated in said recessed area.

8. The article of footwear of claim 1, wherein said support member is embedded in said sole.

9. The article of footwear of claim 1, wherein said support member is made of metal.

10. The article of footwear of claim 1, wherein said support member is made of a carbon fiber material.

11. A footwear component comprising:

a support member configured for placement on a sole of a shoe, said support member including a first part and a second part, said first part extending at least partially into a forefoot portion of the sole, and said second part extending from said first part and at least partially into a heel portion of the sole, said first part including a lateral support member and a medial support member that are attached to each other and form a closed loop having a central opening, an outer edge of said lateral support member and said medial support member combining to form an outermost edge having a continuous convex curvature from a lateral side to a medial side of the sole, said support member having a front end portion having a concave curve in a vertical direction and a rear end portion having a concave curve in a vertical direction.

12. The footwear component of claim 11, wherein said medial support arm extends along a medial side of the sole, and said lateral support arm extends along a lateral side of the sole.

13. The footwear component of claim 12, wherein said medial support member and said lateral support member are curved.

14. The footwear component of claim 11, wherein said first part of said support member extends from a midfoot portion of the sole to the forefoot portion.

15. The footwear component of claim 11, wherein said second part of said support member extends from a midfoot portion of the sole to the heel portion.

16. The footwear component of claim 11, wherein said first part has a width that is greater than a width of said first part of said support member.

17. The footwear component of claim 11, wherein said support member is made of metal.

18. The footwear component of claim 11, wherein said support member is made of a carbon fiber material.

19. The article of footwear of claim 1, wherein said support member includes an intermediate portion extending between said front end portion and said rear end portion, wherein said intermediate portion has a concave curve.

20. The footwear component of claim 11, wherein said support member includes an intermediate portion extending between said front end portion and said rear end portion, wherein said intermediate portion has a concave curve.

* * * * *